US008498440B2

(12) United States Patent
Parkins et al.

(10) Patent No.: US 8,498,440 B2
(45) Date of Patent: Jul. 30, 2013

(54) EARTIP WITH TETHER

(75) Inventors: John W. Parkins, Ithaca, NY (US); Mark DeWilde, Ithaca, NY (US)

(73) Assignee: Red Tail Hawk Corporation, Ithaca, NY (US)

( * ) Notice: Subject to any disclaimer, the term of this patent is extended or adjusted under 35 U.S.C. 154(b) by 21 days.

(21) Appl. No.: 13/221,515

(22) Filed: Aug. 30, 2011

(65) Prior Publication Data

US 2012/0051578 A1 Mar. 1, 2012

Related U.S. Application Data

(60) Provisional application No. 61/416,631, filed on Nov. 23, 2010, provisional application No. 61/378,492, filed on Aug. 31, 2010.

(51) Int. Cl.
*H04R 25/00* (2006.01)

(52) U.S. Cl.
USPC ..... 381/380; 381/328; 381/329

(58) Field of Classification Search
USPC ..... 381/322, 324, 325, 326, 328, 329, 381/380, 382; 181/129, 130, 135; 128/864, 128/867
See application file for complete search history.

(56) References Cited

U.S. PATENT DOCUMENTS

| | | | | |
|---|---|---|---|---|
| 6,473,513 | B1 * | 10/2002 | Shennib et al. | 381/328 |
| 8,184,842 | B2 * | 5/2012 | Howard et al. | 381/328 |
| 2007/0240931 | A1 | 10/2007 | Killion | |

* cited by examiner

*Primary Examiner* — Huyen D Le
(74) *Attorney, Agent, or Firm* — Brown & Michaels, PC

(57) ABSTRACT

An eartip made of a resilient body with an eartip core inside the open center of the body, and a tether attached to the eartip core at an attachment region along the length of the core. A free end of the tether extends outward from the eartip, allowing a wearer to remove the eartip from their ear by pulling on the tether.

20 Claims, 5 Drawing Sheets

EARTIP WITH TETHER

REFERENCE TO RELATED APPLICATIONS

This application claims one or more inventions which were disclosed in Provisional Application No. 61/378,492, filed Aug. 31, 2010, entitled "EARTIP WITH LEASH", and also Provisional Application No. 61/416,631, filed Nov. 23, 2010, also entitled "EARTIP WITH LEASH". The benefit under 35 USC §119(e) of these United States provisional applications is hereby claimed, and the aforementioned applications are hereby incorporated herein by reference.

ACKNOWLEDGEMENT OF GOVERNMENT SUPPORT

This invention was made with Government support under SBIR contract N68335-10-C-0329, awarded by the US Navy. The government has certain rights in the invention.

BACKGROUND OF THE INVENTION

1. Field of the Invention

The invention pertains to the field of sound producing earplugs. More particularly, the invention pertains to eartips for sound producing earplugs.

2. Description of Related Art

Eartips are typically attached to sound producing earpieces to form in-ear earphones or "ear buds". Earpieces may be custom-made, to form fit to an individual user, or universally-fitting. Eartips are typically constructed out of foam materials, or elastomers such as silicone, in various shapes. The eartip generally creates an acoustic seal with the canal walls which prevents undesirable noise from being heard by the user.

For illustrative purposes, FIG. 1A shows a simple eartip in the form of a foam cylinder 1 with a rubber sound tube 2 glued internally to carry the sound into the ear from an earpiece into the ear.

FIG. 1B is a cross-section of a contoured foam eartip having a tapered cylindrical resilient body 3 with a rubber sound tube 2. One such foam design is shown in US published application No. 2007/0240931 by Killion.

FIG. 1C is a cross-section of a flanged elastomeric tip having a body 4 with flanges 5, usually made from a silicone material. The flanges 5, made of elastomeric material, serve to seal the tip to the ear canal, while the channel 6 in the center serves to couple sound from a speaker in an earpiece to the human ear canal.

FIG. 1D illustrates a foam eartip 7 installed on a custom-molded earpiece 8. The custom earpiece 8 is typically made from an impression of the user for which the device is made. Eartips may also be installed on universally-fitting earpieces.

The effectiveness of any plug at keeping out undesirable outside sounds is determined partially by the depth in the ear canal to which the device is inserted. Deeper insertion generally yields greater attenuation of the undesirable outside sounds. Attenuating outside sounds permits reducing the sound levels required in the ear canal to create a comfortable and useful listening level for communications signals (such as music or speech). Moreover, in loud environments, higher noise attenuation can prevent hearing loss. Additionally, the less air volume there is inside the ear canal to be driven by the speaker in the earpiece, the less energy is required in the system which results in smaller and lighter energy sources, and longer operating life per charge or battery replacement. Finally, deeper insertion reduces the occlusion effect, wherein the wearer's own voice seems to "boom" and be artificially loud while wearing the plugs. It is very desirable, therefore, to place these eartips deeply in the ear canal.

The primary impediment to placing eartips deeply in the ear canal has been the problem of removing them. If they are installed on an earpiece which places them deeply in the canal, then it is possible when removing the earpiece from the ear for the eartip to detach and remain deep in the canal. In this case, medical assistance may be needed to remove the eartip from the canal. The potential for this failure mode can discourage manufacturers from deploying solutions that take advantage of deep placement regardless of the many advantages of doing so.

SUMMARY OF THE INVENTION

The invention provides an eartip made of a resilient body with an eartip core with sound channel inside the open center of the body, and a tether attached to the eartip core at an attachment region along the length of the core. A free end of the tether extends outward from the eartip, allowing a wearer to remove the eartip from their ear by pulling on the tether.

DETAILED DESCRIPTION OF THE INVENTION

While one approach to the problem of eartips detaching would be to create a means of attaching the eartips to the earpiece in a manner which would virtually guarantee them never coming off in the ear during removal, any mechanism of doing so would likely make the eartip non-replaceable or difficult to use. Because foam-based eartips are intended to be replaced almost daily, this approach is not practical. The eartip disclosed herein involves the integration of a strong, small diameter, semi-rigid tether to the eartip. If the eartip detaches, the tether provides a convenient means for retrieval. In order to minimize interference by the tether with the seal between the ear and the earpiece, and to reduce discomfort, the tether is captured within the housing of the custom or universal fit earpiece when the eartip is installed.

Figure 2A:
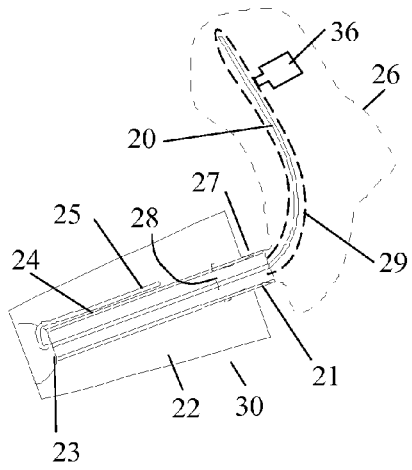
FIG. 2A shows a simple method of attaching a tether.

FIG. 2A illustrates a simple method of attaching the tether 20, in an application using a tapered cylindrical eartip 30 having a tapered resilient body 22 and a sound tube 21 inside an open center of the resilient body 22. The eartip 30 is fit upon an earpiece 26 with an internal speaker 36 to create a sound producing earplug. It will be understood that the wire connections to the speaker 36 are omitted for clarity purposes.

In this embodiment, a tether 20 passes through the sound tube 21 in the foam eartip body 22, out the end 23 of the sound tube 21, then folds back between the outside surface 24 of the sound tube 21 and the foam eartip body 22.

The resilient body 22 is preferably made of foam, but could also be made of silicone or other resilient materials known to the art. The body 22 is preferably a tapered cylinder, but could also be as shown and discussed in reference to prior art FIGS. 1A-1D, above.

The tether 20 is preferably made of a monofilament line (such as fishing line). Tethers made of other materials may be used, so long as they are relatively small in diameter relative to the sound tube 21, and also are flexible and high in tensile strength.

One assembly procedure is to fabricate the resilient body 22, sound tube 21, and tether 20 separately. The tether is given a crimp to pre-form the tether 20 with a sharp bend. The tether 20 is then threaded through the sound tube 21. An adhesive such as glue is applied to the outer surface 24 of the sound tube 21 and the portion 25 of the tether 20 that will make contact with the foam 22. Last, the resilient body 22 is placed over the sound tube 21 before the glue has cured. The resilient body 22 will trap the folded-back part 25 of the tether 21 between itself and the sound tube 21 and will help hold the tether 20 against the sound tube 22 while the glue cures. In this embodiment, the tether 20 is not attached to the inside of the sound tube 21.

This enables the sound tube 21 to be attached to a custom-fitting earpiece 26 using a nipple 27 where the tether 20 slides into an orifice 28 in the nipple 27. The sound tube 21 can stretch over and around the nipple 27, held in place by friction and a lip in the nipple 27. There are other means of attaching the eartip 20 to the nipple 27, such as a screw-on type.

The earpiece 26 is built with a cavity or channel 29 to allow the tether 20 to be fed into it as the eartip is installed and to provide a means by which sound is delivered from the speaker 36 to the ear canal. If the eartip comes off the earpiece 26 when removing the earpiece 26 from the user's ear, the tether 20 extends to outside the ear canal opening and is accessible. By using one's fingers to pinch the tether 20, one can pull the eartip out of the ear canal. Even if the tether 20 doesn't extend completely out of the ear canal, it still provides an easier means to remove a detached eartip by using tweezers or other tool.

Figure 2B:
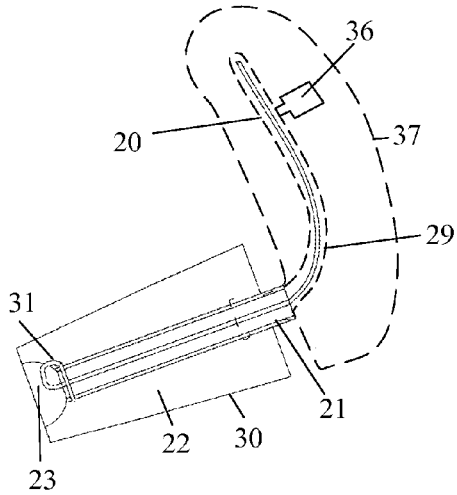
FIG. 2B shows another method of attachment of a tether, with the eartip on a universally-fitting earpiece.

FIG. 2B illustrates another method of attachment of a tether 20. A loop 31 is formed at the end of the tether and placed around the end 23 of the sound tube 21. The free end of the tether 20 is passed down the sound tube 21 and into sound channel 29 in a universally-fitting earpiece 37.

Figure 2C:
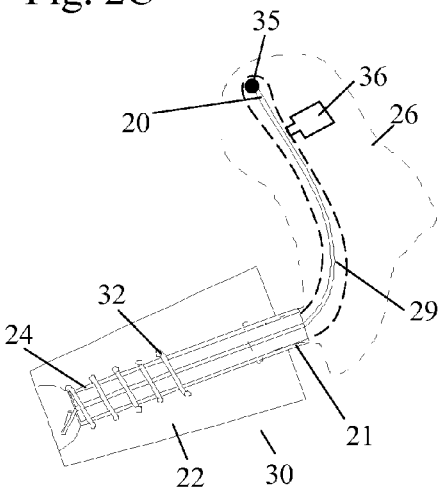
FIG. 2C shows coiling a tether around the outside of an eartip core.

FIG. 2C illustrates another method of attaching the tether 20 to the eartip 30. In this embodiment, the tether 20 is wrapped in coils 32 around the outside 24 of the sound tube 21 prior to installation of the sound tube 21 within the resilient body 22. Coiling the tether 20 enables a greater length of tether 20 to be glued to the outside 24 of the sound tube 21 for increased adhesion.

Figure 2D:
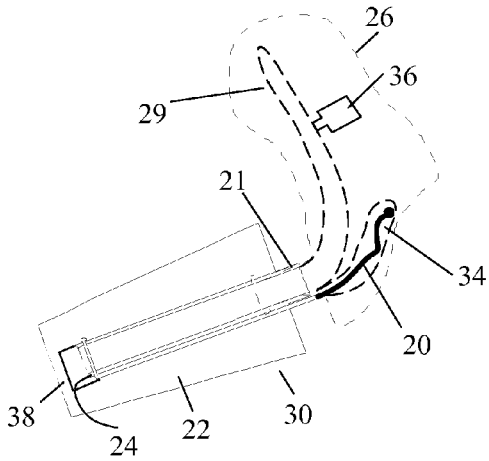
FIG. 2D shows routing a tether along the outside of an eartip core.

FIG. 2D illustrates still another method of attaching the tether 20. In this embodiment, the tether 20 does not pass through the sound tube 21. Instead, the tether 20 is attached to the outer surface 24 of the sound tube 21 and threaded instead into an alternate passage 34 in the earpiece 26, such as a separate tube or a cavity. This method places additional constraints on the design of the earpiece 26, since additional channels 34 need to be provided if a channel 29 is used for providing a communications or other audio signal. Any method of securing the tether 20 to the sound tube 21, for example those described above in FIGS. 2A-2C, may be employed in this configuration as well.

FIG. 2D also shows an embodiment in which the open center of the resilient body 22 extends substantially through the body 22, but not entirely through as shown in the other figures. In this embodiment a small sound-permeable layer of resilient material 38 closes off the inner end of the center of the resilient body 22.

These and many more variations on attachment methods are possible for both routings of the tether.

In preparation for use, the tether 20 is threaded into the earpiece cavity or tubing 29, and then the eartip 30 is pushed (or screwed or other means) onto a nipple 27 or other means of attachment. In practice, other types of attachment such as twist-lock or snap attachments are equally possible and are made easier by the tether 20 being threaded through the sound tube 21 as mentioned.

The resilient body 22 is rolled down, in the case of foam eartips, and the earpiece 26 and eartip 30 are inserted into the ear and positioned with the earpiece for comfort and full insertion depth. When the earpiece 26 is removed, the foam eartip 30 will typically remain attached to the earpiece 26, so that both are removed from the ear together.

If, however, the eartip 30 does become detached, the tether 20 will slide out of the earpiece 26 and will extend past the opening of the ear canal where it may be grasped with the fingers and used to pull the eartip 30 out of the ear canal.

Figure 1A:
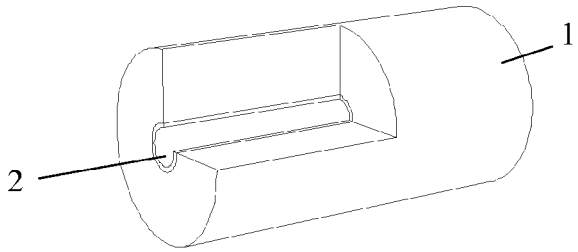
Fig. 1A PRIOR ART
FIGS. 1A-1D show prior art eartips.
Figure 1B:
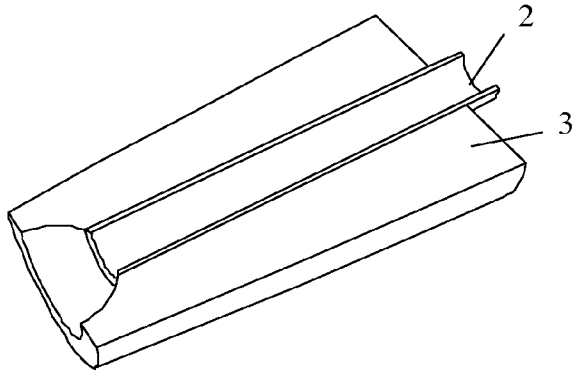
Fig. 1B PRIOR ART
Figure 1C:
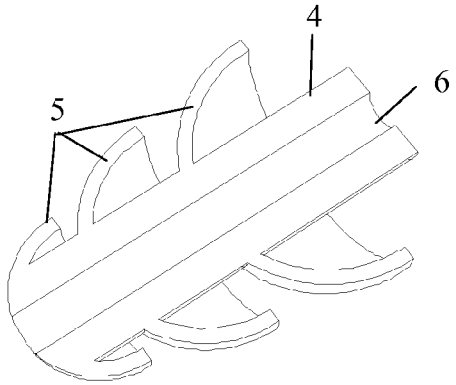
Fig. 1C PRIOR ART
Figure 1D:
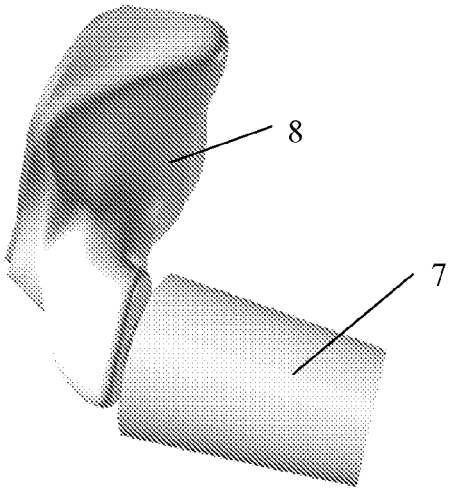
Fig. 1D PRIOR ART

The tether 20 can also be embedded into the molded silicone elastomer types of eartips as shown in FIG. 1C, and will perform the same functions. The spiral version of tether, shown in FIG. 2C is particularly effective when embedded in a silicone or other elastomer eartip.

The preferred material chosen for the tether 20 is a strong semi-rigid material, such as nylon monofilament. This prevents the tether 20 from folding and resting inside the ear canal out of reach as would happen with a soft and highly flexible (limp) cord.

The end of the tether 20 intended to be grasped can be modified with the addition of a small formed sphere 35, as shown in FIG. 2C, to aid both in grasping with the fingers and in feeding through the channels or cavities in the earpiece. One way of creating the sphere 35 at the end of the tether 20 is by exposing the end to heat and melting the end so that a ball shape is formed.

It will be understood that other means of attaching the tether 20, including those shown in FIGS. 2B-2D, are possible.

Figure 3:
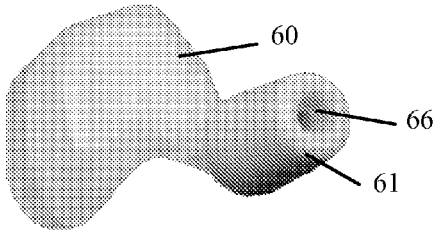
FIG. 3 shows a photograph of an eartip attached to a custom-molded plastic earpiece.

FIG. 3 shows a photograph of an embodiment of the invention attached to a custom-molded plastic earpiece 60. The custom earpiece 60, or custom shell, is seen as it would fit in an ear 70 in FIG. 4C. The ear 70 shown in the photograph is an artificial ear used in acoustical testing and is of the general size of a human ear.

Figure 4A:
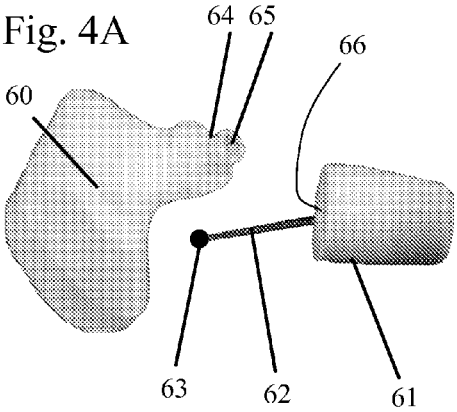
FIGS. 4A and 4B show photographs of assembling an embodiment of the eartip of the invention to a custom-molded plastic earpiece.

FIG. 4A shows the earpiece 60, or custom shell. The earpiece 60 has a sound nipple 64 with a sound channel or passage 65 for routing sound from a speaker (77 in FIG. 6) into the user's ear. The sound nipple 64 has a slight lip that helps secure the eartip 61 to the earpiece 60. The eartip 61 is shown next to the earpiece 60, with its tether 62 extending from the sound tube 66 through the eartip 61. A ball 63 is provided at the tip of the tether 62 to aid in gripping the tether 62.

Figure 4B:
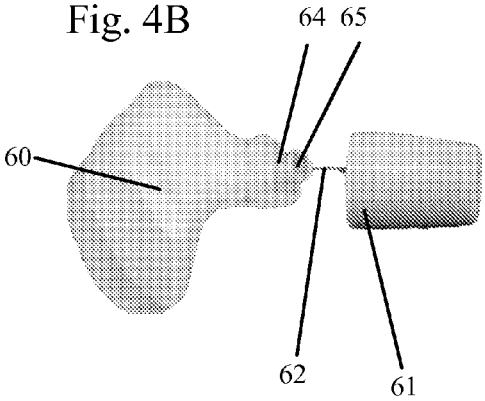

FIG. 4B shows the tether 62 being inserted into the sound channel 65 through the sound nipple 64 of the earpiece 60. When the tether 62 is inserted into the sound channel 65 of the earpiece 60, it does not interfere with the ear canal 67, shown in FIG. 4C, which would be uncomfortable and create a potential acoustic leak. The tether 62 is of small enough diameter that it does not appreciably hinder the ability of sound to travel through the sound channel 65 of the earpiece 60 and through the sound tube 66 of the eartip 61.

Figure 4C:
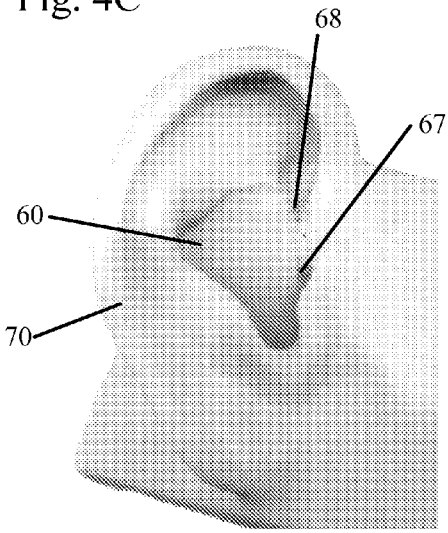
FIG. 4C shows a photograph of an ear with an earpiece in place.

The foam eartip 61 when attached to the earpiece 60 would extend deep into the ear canal 67, while the earpiece 60 fits in the concha 68 of the ear 70, as shown in FIG. 4C. If the user removed the earpiece 60, and the eartip 61 became detached, the earpiece 61 could be too deep into the ear canal 67 to remove with human fingers. However, when using an eartip 61 with a tether 62, as described herein, the tether 62 can be pinched between the fingers and pulled, pulling out the complete eartip 61.

Figure 4D:
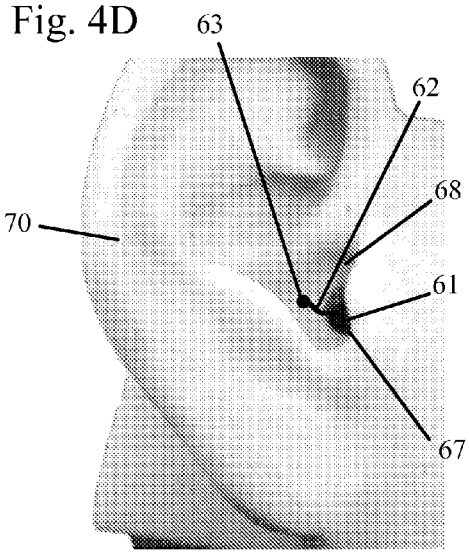
FIG. 4D shows a photograph of an ear with the eartip and tether remaining after removal of the earpiece.

FIG. 4D shows how the tether 62 would protrude from the ear canal 67 if the earpiece 60 were removed from the ear 70 and the eartip 61 became detached. The end of the tether 62 extends past the entrance of the ear canal 67 enough that it can be grabbed with fingers, and thus pulling the eartip 61 out of the ear canal 67. Preferably, as shown in FIG. 4D, the end of the tether 62 was heated so that it would form a ball 63 which would be easier to grab. The ball 63 also makes it easier to insert the tether 62 into a sound channel 65 in the earpiece 60 because the ball 63 is curved and smooth and will tend to slide into the sound channel 65 easier than an end that is cut and has corners.

Figure 5:
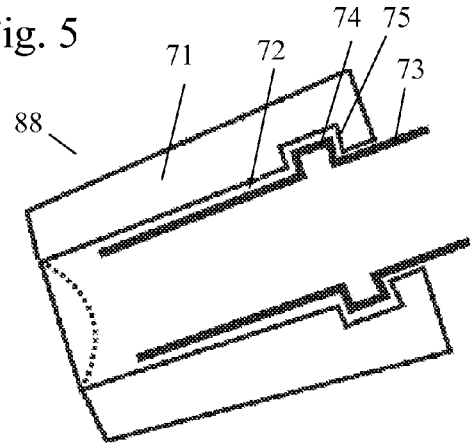
FIG. 5 shows the construction details of a commercially available eartip made of foam glued to a core.

FIG. 5 shows the construction details of a commercially available eartip 88 made of a resilient body 71 bonded to a core 73 with a layer of glue 72. The resilient body 71 is typically made of slow-recovery foam, and the core 73 can be made of stiff or compliant material. A compliant material, such as silicone, is sometimes used for the core 73 because it allows the eartip 88 to flex when being inserted into the ear. The core can be formed with a widened area 74, which forms a flange on the outside and a groove on the inside. The widened area 74 can fit into a groove 75 in the body 71 to provide a positive fit between the body 71 and core 73.

The core 73 provides a mechanical attachment means to an earpiece. The earpiece may be universal-fitting or of a custom-molded style that fits the features of a specific individual. FIGS. 6-11 show an example of a custom-molded style earpiece 76. The earpiece 76 may be made of a plastic shell, solid plastic, silicone, or other materials.

The earpiece 76 is used for communications purposes and incorporates a speaker 77 within its body. Wires used to power the speaker 77 are not shown for clarity reasons. For sound to travel to the user's ear canal, a sound channel 78 must be provided. A nipple 79 is a feature of the earpiece 76 shown in FIG. 6 that is used to mechanically attach an eartip 88, for example the eartip 88 shown in FIG. 5. When an eartip 88 is attached to the nipple 79, the eartip 88 is retained by the earpiece during insertion and extraction of the earpiece and eartip 88 from the human ear.

Figure 6:
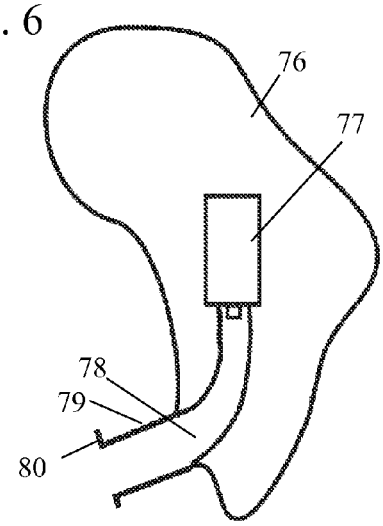
FIG. 6 shows an example of a custom-molded style earpiece.
Figure 7:
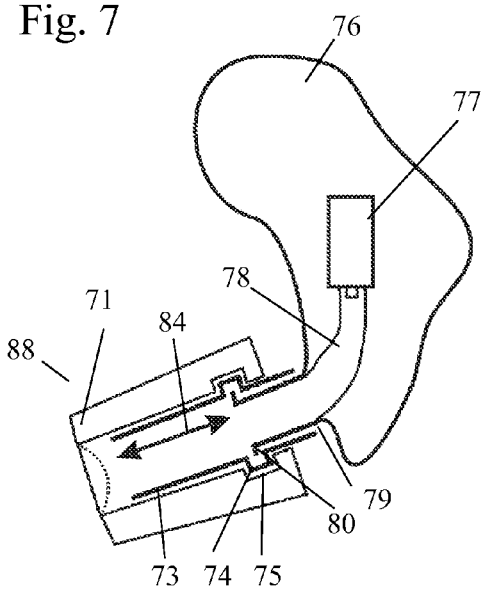
FIG. 7 shows the eartip from FIG. 5 as it is attached to the earpiece of FIG. 6.

FIG. 7 shows the eartip 88 from FIG. 5 as it is attached to the earpiece 76 of FIG. 6. A ridge 80 of the earpiece nipple 79 fits in the groove 74 of the eartip 88 to help with retention. Other retention schemes may be used, such as a screw-type geometry.

Figure 8:
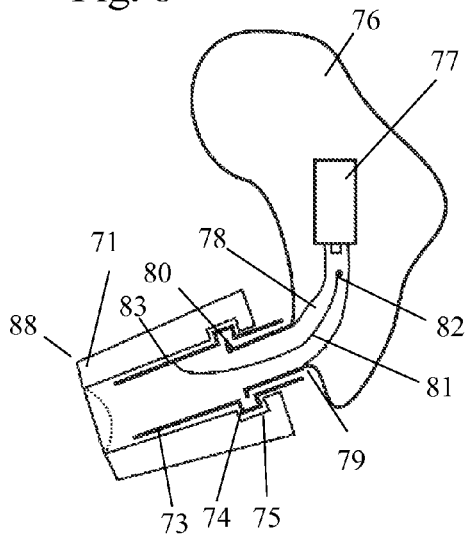
FIG. 8 shows an example of a tether attached to an eartip.

FIG. 7 indicates the proper attachment region 84 for a tether 81, shown in FIG. 8, to enter the core 73. The tether 81 enters the core 73 of the eartip 88 where it will not interfere with the nipple 79 to eartip 88 attachment region and so that it may be easily fed into the sound channel 78. The attachment point of the tether 81 may be within the core 73, on the outside of the core 73, or on the inside of the core 73 in any region so long as it enters the core 73 in the tether entrance region 84.

FIG. 8 shows an example of a tether 81 attached to the eartip 88 core 73 at an attachment point 83. The tether 81 enters the core 73 and earpiece nipple 79 and resides within the sound channel 78. It can be seen that the tether 81 will not interfere with the attachment of the eartip 88 core groove 74 to the ridge 80 of the earpiece nipple 79.

The diameter of the tether 81 is chosen to provide the tensile strength needed to withdraw the eartip 88 without breaking, but small enough in size so as not to reduce the open area of the sound channel 78 below acceptable limits. That is, if the tether 81 diameter is too large in comparison to the cross-sectional area of the sound channel 78, it will impede sound from traveling down the sound tube channel 78. Tethers of diameter 0.013 inch can be used effectively as well as other sized tethers.

Figure 9:
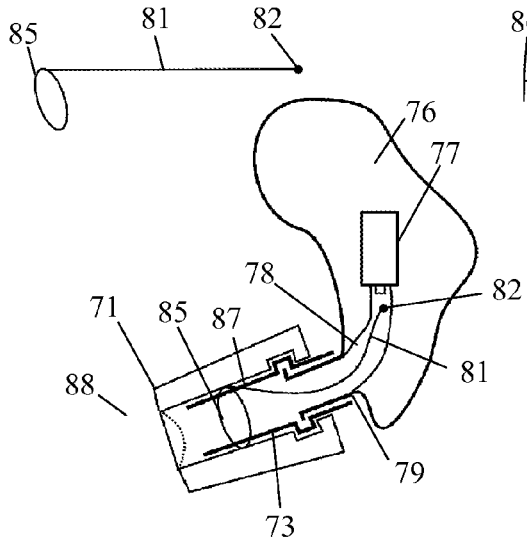
FIG. 9 shows one example of a tether used in one embodiment of the invention.

FIG. 9 depicts one example of a tether 81 used in one embodiment of the invention. The tether 81 is molded of a stiff material such as plastic or monofilament with a loop 85 at one end and a ball 82 at the other end. The loop 85 of the tether 81 is placed around the outside of the core 73 of the eartip 88. A small hole 87 is made in the core 73 for the tether 81 to penetrate through so that it travels through the core 73 and into the sound channel 78. The foam 71 of the eartip 88 is glued to the core 73. If the eartip 88 comes off the earpiece 76 and remains in the ear, the user pulls the ball end 82 of the tether 81 to retrieve the eartip 88.

Figure 10:
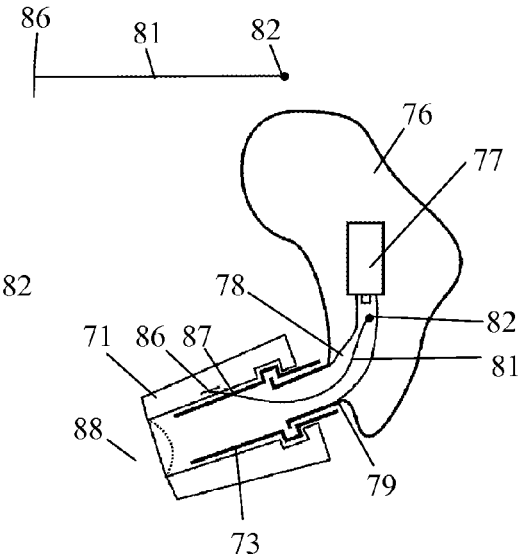
FIG. 10 shows another example of a tether geometry.

FIG. 10 depicts another example of a tether 81 geometry. The tether 81 is molded so as to have a "T" 86 at one end and a ball 82 at the other. The ball end 82 of the tether 81 passes through a small hole 87 made in the core 73, while the "T" end 86 presses against the outside of the core 73 if the ball end 82 of the tether 81 is pulled.

Figure 11:
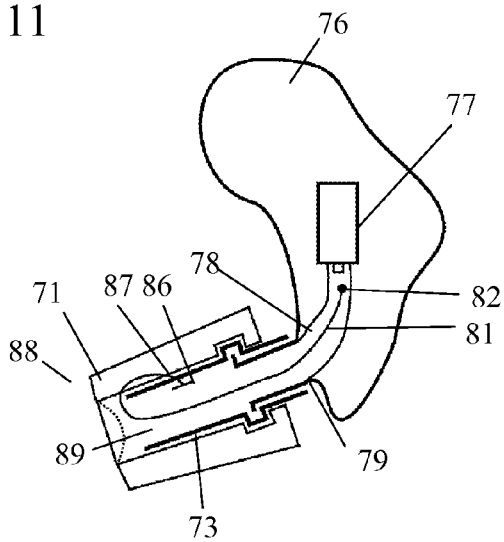
FIG. 11 shows another method of attaching a tether.

In FIG. 11, another method of attaching the tether 81 is shown, using the same tether design as in FIG. 10. In this case, the ball end 82 of a tether 81 is fed through a small hole 87 in the core 73 so that the "T" section 86 remains inside the core 73. The tether 81 wraps around the core 73 and back in through the open end 89 of the core 73. If the eartip 88 comes off in an ear, the user pulls on the ball end 82 of the tether 81. The "T" section 86 of the tether 81 ensures that the core 73 and resilient body 71 of the eartip 88 are retrieved with the tether 81.

The tether 81 may also be molded into the core 73 during fabrication, in the region 84 indicated in FIG. 7. The tether 81 and core 73 may be made of the same material and molded at the same time so long as the tether 81 is small enough in diameter not to significantly hinder sound from reaching the user's ear when a speaker is used in the earpiece, and as long as it is strong enough not to break under the tension needed when retrieving the eartip 88 from an ear.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. An eartip, comprising:

a) a resilient body having an inner end for insertion into an ear, an outer end, and a length therebetween, having an open center extending through the length of the body substantially from the outer end to the inner end;

b) an eartip core inside the open center of the body, having an inner end adjacent to the inner end of the body, an outer end adjacent the outer end of the body, and a length therebetween with an open central passage from the inner end to the outer end; and c) a tether having a first end coupled to the eartip core at an attachment region along the length of the core, a free end and a length therebetween, the free end of the tether extending outward from the outer end of the eartip core.

2. The eartip of claim 1, in which the inner end of the eartip core is recessed within the open center of the body from the inner end of the body.

3. The eartip of claim 1, further comprising an earpiece having a body molded to fit within an ear, a nipple coupled to the outer end of the eartip core, a speaker, and a sound channel acoustically coupled to the speaker and passing through the body of the earpiece and the nipple, such that when the nipple is coupled to the outer end of the eartip core, at least part of the length of the tether is within the sound channel of the earpiece.

4. The eartip of claim 3, in which the outer end of the eartip core protrudes from the outer end of the body, for attachment of the eartip to the nipple of the earpiece.

5. The eartip of claim 1 in which the resilient body of the eartip further comprises a plurality of flanges of elastomeric material.

6. The eartip of claim 1, in which the free end of the tether comprises a ball.

7. The eartip of claim 1, in which the length of the tether is at least partially located within the open central passage of the core.

8. The eartip of claim 1, in which the first end of the tether is passed through a hole in the attachment region of the eartip core.

9. The eartip of claim 8, in which the first end of the tether comprises a T, such that when the first end of the tether is passed through the hole in the attachment region of the eartip core, the T lodges against a surface of the attachment region of the eartip core, coupling the first end of the tether to the eartip core.

10. The eartip of claim 8, in which the first end of the tether is formed into a loop, such that the first end of the tether is coupled to the eartip core by passing the first end of the tether from the central passage through the hole in the attachment region of the eartip core and wrapping the loop around the eartip core.

11. The eartip of claim 8, in which the first end of the tether is coupled to the attachment region of the eartip core by folding the first end of the tether back along an outer surface of the eartip core and securing the first end of the tether to the outer surface of the eartip core.

12. The eartip of claim 8, in which the first end of the tether is formed into a loop, such that the first end of the tether is secured to the outer surface of the eartip core by passing the first end of the tether through the central passage of the eartip core and inward through the inner end of the eartip core, folding the first end back toward the outer end of the eartip core and wrapping the loop around an outer surface of the eartip core.

13. The eartip of claim 1, in which the eartip core is glued to the resilient body.

14. The eartip of claim 1, in which the tether is monofilament line.

15. The eartip of claim 1, in which the tether has a diameter small enough that it does not block sound passage through the central passage of the eartip core.

16. A method of making an eartip comprising a resilient body having an inner end for insertion into an ear, an outer end, and an open center extending between the inner end and the outer end; an eartip core having an inner end, an outer end, and a length therebetween with an open central passage from the inner end to the outer end; and a tether having a first end, a free end and a length therebetween, the method comprising:

a) threading the first end of the tether through central passage of the eartip core from the outer end to the inner end, leaving the free end of the tether extending from the outer end of the eartip core;

b) securing the first end of the tether to an attachment region of the eartip core;

c) inserting the inner end of the eartip core into the outer end of the open center of the resilient body; and d) pushing the eartip core into the open center of the resilient body until the eartip core is in a desired location relative to the resilient body.

17. The method of claim 16, further comprising the step, before step (a) of pre-forming the first end of the tether with a sharp bend, and wherein the step of securing the first end of the tether to an attachment region of the eartip core comprises applying an adhesive to an outer surface of the eartip core and pressing the first end of the tether into the adhesive.

18. The method of claim 16, in which the first end of the tether is formed into a loop, and wherein the step of securing the first end of the tether to an attachment region of the eartip core comprises placing the loop at the first end of the tether around an outer surface of the eartip core.

19. The method of claim 16, in which the first end of the tether is formed into a T, and wherein the step of securing the first end of the tether to an attachment region of the eartip core comprises inserting the T through a hole in the eartip core.

20. The method of claim 16, further comprising:

e) inserting the free end of the tether into a sound channel of an eartip; and f) attaching the outer end of the eartip core to a nipple of the earpiece, such that at least part of the length of the tether extends through the nipple into the sound channel when the eartip core is attached to the nipple of the earpiece.

* * * * *